US011577297B2

(12) United States Patent
Yuan et al.

(10) Patent No.: US 11,577,297 B2
(45) Date of Patent: Feb. 14, 2023

(54) ACCURATE SPRINGBACK COMPENSATION METHOD FOR HYDROFORMING COMPONENT BASED ON LIQUID VOLUME CONTROL

(71) Applicant: Harbin Institute of Technology, Harbin (CN)

(72) Inventors: Shijian Yuan, Harbin (CN); Wei Liu, Harbin (CN)

( * ) Notice: Subject to any disclaimer, the term of this patent is extended or adjusted under 35 U.S.C. 154(b) by 561 days.

(21) Appl. No.: 16/627,795

(22) PCT Filed: Nov. 29, 2018

(86) PCT No.: PCT/CN2018/118067
§ 371 (c)(1),
(2) Date: Dec. 31, 2019

(87) PCT Pub. No.: WO2020/015268
PCT Pub. Date: Jan. 23, 2020

(65) Prior Publication Data

US 2021/0331226 A1 Oct. 28, 2021

(30) Foreign Application Priority Data

Jul. 20, 2018 (CN) ..... 201810822673.3

(51) Int. Cl.
*B21D 26/041* (2011.01)

(52) U.S. Cl.
CPC ..... *B21D 26/041* (2013.01)

(58) Field of Classification Search
CPC .... B21D 26/02; B21D 26/021; B21D 26/027; B21D 26/033; B21D 26/041
See application file for complete search history.

(56) References Cited

U.S. PATENT DOCUMENTS 6,006,567 A * 12/1999 Brown ..... B21D 26/045 72/58
7,266,982 B1 * 9/2007 Guza ..... B21D 37/16 72/60
7,313,939 B2 * 1/2008 Nobata ..... B21D 22/22 72/60

* cited by examiner

*Primary Examiner* — Teresa M Ekiert
(74) *Attorney, Agent, or Firm* — Novoclaims Patent Services LLC; Mei Lin Wong

(57) ABSTRACT

An accurate springback compensation method for sheet hydroforming component based on liquid volume control is related to a springback compensation method for curved surface part hydroformed with liquid as a punch during deep drawing process. According to the difference between a theoretical volume and a post-springback volume of a target part, an elastic deformation of the die is induced by liquid pressure, the die deformation amount is controlled to be equal to the springback amount. The accurate springback compensation control of a curved surface part is realized to overcome the problems of thickness or mechanical properties variations for different batches of sheets, and the manufacture error of the mould is considered to meet the design requirements. The liquid volume compensation is on-line and in-situ performed without mould re-machining. The advantages is good precision, simple process, high efficiency, short cycle and low cost.

9 Claims, 9 Drawing Sheets

ACCURATE SPRINGBACK COMPENSATION METHOD FOR HYDROFORMING COMPONENT BASED ON LIQUID VOLUME CONTROL

BACKGROUND OF THE PRESENT INVENTION

Field of Invention

The present invention relates to a method for accurately compensating springback effect of a metal sheet member, and more particular to an accurate springback compensation method for a metal curved plate member hydroformed with liquid as a punch during deep drawing process.

Description of Related Arts

Springback is a typical form of defect during the formation of sheet components, which directly affects the dimensional accuracy of the components. The springback occurs because the external load is removed after the sheet is formed, and the internal stress is induced to distribute again, resulting in uneven distribution of residual stress, which leads to changes in the size of the component. Generally, the size and shape of the sheet metal component after springback is no longer equal to those of the geometrical surface of the mould. If the mould is machined according to the designed profile of the component, the dimensional accuracy that meets the designed dimension precision cannot be obtained. Until now, an effective method for springback compensation of rigid mould forming is the reverse compensation method based on modification of mould profile. This method compares the theoretical profile with the profile after-springback of the component, reversely adjusts the mould according to the deviation of the two profile surfaces, so that the geometrical profile of the component after-springback is corrected to exactly the same as the theoretical profile. However, the mould modification time is up to several months, and it is unable to solve the problem of excessive fluctuation caused by fluctuations in performance of different batches of sheets, and it is difficult to directly compensate springback on-line and in-situ, resulting in long cycle and high cost. At the same time, due to the increase of material strength (high-strength aluminum alloy, high-strength steel, superalloy, titanium alloy, etc.) and the increase in the size of the components, the springback problem becomes more and more serious. Therefore, the traditional rigid mould forming is difficult to accurately control the springback effect.

Hydroforming is the technology of liquid to be used as a flexible force transition medium to replace one part of rigid mould, so that the sheet is pressed against the mould profile under the action of liquid pressure, thereby deforming the component into a desired shape. In addition to the mould profile reverse compensation method, hydroforming can also control the springback by regulating the pressure, which is a unique advantage of hydroforming in terms of springback compensation compared with conventional forming methods with rigid tools. According to the action direction of the liquid, the sheet hydroforming can be divided into deep drawing with liquid as a die and deep drawing with liquid as a punch. For the deep drawing with liquid as a die, liquid is applied as the backward pressure instead of concave die, the mouldability of the sheet and the punch can be improved by increasing the backward pressure, thus reducing the residual stress of the formed component. For the deep drawing with liquid as a punch, in the final stage of forming process, when the component is basically pressed against the mould, the pressure is increased to make the component fully-deform. Likewise, the in-plane stress is induced. On the one hand, the residual stress of the component is reduced. On the other hand, the distribution uniformity of the residual stress in the inner and outer layers of the component is improved, and the inner and outer stress differences and springback bending moments are reduced.

However, conventional hydroforming methods control the srpingback by liquid pressure controlling. The hydraulic pressure in the hydroforming process is related to the material thickness, strength and the dimension of the mould. When the feature size of mould is constant, the hydraulic pressure is affected by fluctuations in the strength and thickness of the sheet. For example, the yield strength of different batches of low carbon steel varies from 235 to 280 MPa. The conventional compensation calculation is based on the intermediate value of the yield strength (or the actual test value of a batch of materials). If the yield strength fluctuation changes to the limit value, it will cause an amount of springback that occur of about ±10%. Therefore, affected by the strength and thickness variation of different batches of sheets, it is difficult to achieve accurate springback compensation by liquid pressure controlling in the conventional hydroforming process, and it is impossible to solve the precision deviation caused by fluctuations in performance of different batches of sheets. In addition, when the machining accuracy is insufficient and the mould profile is out of tolerance, the mould profile deviation and springback effect will be accumulated, causing the dimensional accuracy of the component more difficult to control, and hence impossible to compensate the springback on-line and in-situ directly.

SUMMARY OF THE PRESENT INVENTION

An object of the present invention is to solve the problems of the existing springback control during hydroforming process through pressure control, that cannot solve the problem of performance change of different batches of plates and the inability to provide on-line and in-situ springback compensation. At the same time, the present invention can solve the problem that the profile precision of the part cannot be accurately controlled due to the error of the mould manufacture, and the quick and accurate springback compensation can be realized without modifying the mould.

Technical solution 1: The present invention provides an accurate springback compensation method for hydroforming component based on liquid volume control, which employs a deep drawing method with liquid as a punch, based on the differences between a theoretical volume and a post-springback volume of a target part, induces an elastic deformation of the die by regulating a volume of liquid injected, during shaping in the post-forming stage, controls the die deformation amount and the springback amount to be equal and realizes accurate springback compensation control of a curved panel parts, comprises the following steps of:

Step 1: According to a designed profile of the curved panel member, calculating the corresponding theoretical volume $V_0$;

Step 2: Placing a plate blank on a die for moulding and filling the die with high pressure liquid through an external pressurization system so that the plate blank begins deep drawing with liquid as a punch under an action of liquid pressure for shape forming;

Step 3: Using a flowmeter to record a change of liquid flow inside the die, when a liquid volume being filled inside the die reaches $V_0$, stopping liquid filling through a control system and unloading;

Step 4: Using a displacement sensor to online and on-site measuring a distance between a profile of the unloaded part and a profile of its corresponding die, calculating an actual volume V of the unloaded part, then calculating to obtain a volume difference $\Delta V$ of $V_0$ and V;

Step 5: Filling the die with high pressure liquid again, when a liquid volume being filled inside the die reaches $V_0$, continuing to fill the die with high pressure liquid until elastic deformation of the die occurs, using a flowmeter to record a change of liquid flow inside the die, when a liquid volume being filled inside the die reaches $V_0+\Delta V$, stopping liquid filling through the control system, then unloading to obtain a curved panel member;

Step 6: For batch forming of subsequent parts, using a loaded volume of $V_0+\Delta V$.

Furthermore, in the step (2), the plate blank is a sheet metal.

Furthermore, the sheet metal includes but not limited to aluminum alloy, low carbon steel, and high strength steel.

Technical solution 2: The present invention provides an accurate springback compensation method for hydroforming component based on liquid volume control, the method based on the differences between a theoretical volume of a target part and a post-springback volume of a deformed part, induces an elastic deformation of the die by regulating a volume of liquid injected, controls the die deformation amount and the springback amount to be equal and realizes accurate springback compensation control of a curved panel parts, comprises the following steps of:

Step 1: According to a designed profile of the curved panel member, calculating the corresponding theoretical volume $V_0$;

Step 2: Placing a plate blank on a die for moulding and filling the die with high pressure liquid through an external pressurization system so that the plate blank begins deep drawing with liquid as a punch under an action of liquid pressure for shape forming;

Step 3: Using a flowmeter to record a change of liquid flow inside the die, when a liquid volume being filled inside the die reaches $V_0$, stopping liquid filling through a control system and unloading;

Step 4: Using a displacement sensor to online and on-site measure a distance between a part profile of the unloaded part and a profile of the corresponding die, calculating an actual volume V of the unloaded part, and calculating to obtain a volume difference $\Delta V$ of $V_0$ and V;

Step 5: Filling the die with high pressure liquid again, when a liquid volume being filled inside the die reaches $V_0$, continuing to fill the die with high pressure liquid until the die is elastically deformed, using a flowmeter to record a change of liquid flow inside the die, when a liquid volume being filled inside the die reaches $V_0+\Delta V$, stopping liquid filling through the control system, and then unloading to obtain a curved panel member;

Step 6: based on the relationship between the liquid volume compression amount $\Delta Vp$ and the liquid pressure p, that is: $\Delta V_p=/\beta\cdot p\cdot V$, calculating the liquid volume compression amount $\Delta Vp=\beta\cdot p\cdot(V0+\Delta V)$ when the liquid volume being filled inside the die is $(V_0+\Delta V)$, where $\beta$ is a compression coefficient of the liquid medium;

Step 7: Filling the die with liquid and pressurizing again until elastic deformation of the die occurs, recording a change of liquid flow inside the die by using a flowmeter, when a liquid volume being filled inside the die reaches $V_0+\Delta V+\Delta Vp$, stopping liquid filling through the control system then unloading to obtain a curved panel member;

Step 8: Proceeding batch forming of subsequent parts using a loaded volume of $V_0+\Delta V+\Delta Vp$.

Technical solution 3: The present invention provides an accurate springback compensation method for hydroforming component based on liquid volume control, the method based on the differences between a theoretical volume of a target part and a post-springback volume of an actual part, induces an elastic deformation of the die by regulating a volume of injected liquid, controls the die deformation amount and the springback amount to be equal and realizes accurate springback compensation control of a curved panel parts, comprises the following steps of:

Step 1: According to a designed profile of the curved panel member and a measured profile of the die cavity, calculating the corresponding theoretical volume $V_0$ and the die cavity volume $V_1$, and calculating to obtain a volume difference $\Delta V_1$ of $V_0$ and $V_1$ according to $\Delta V_1=V_0-V_1$;

Step 2: Placing a plate blank on a die for moulding and filling the die with high pressure liquid through an external pressurization system so that the plate blank begins deep drawing with liquid as a punch under an action of liquid pressure for shape forming;

Step 3: Recording a change of liquid flow inside the die by using a flowmeter, when a liquid volume being filled inside the die reaches $V_1$, continuing to fill the die with liquid of high pressure through an external pressurization system until the die is elastically deformed, recording a change of liquid flow inside the die by using a flowmeter, when a liquid volume being filled inside the die reaches $V_1+\Delta V_1=V_0$, stopping liquid filling through the control system and unloading;

Step 4: using a displacement sensor to online and on-site measuring a distance between a part profile after unloading and a profile of the corresponding die, calculating an actual volume V of the unloaded part, and calculating a volume difference $\Delta V$ of $V_0$ and V according to $\Delta V=V_0-V$;

Step 5: Filling the die by liquid and pressurizing again until the die is elastically deformed, recording a change of liquid flow inside the die by using a flowmeter, stopping liquid filling through the control system when a liquid volume being filled inside the die reaches $V_0+\Delta V$, then unloading to obtain a curved panel member;

Step 6: Proceeding batch forming of subsequent parts using a loaded volume of $V_0+\Delta V$.

The advantageous effect of the present invention:

The present invention employs a deep drawing method with liquid as a punch, through calculating a theoretical volume and a post-springback actual volume of a target part, induces an elastic deformation of the die by regulating a volume of injected liquid, controls the die deformation amount equal to the springback amount, realizes accurate springback compensation control of a curved panel parts so that the component size meet the design requirements. The present invention does not need to re-machine the die, and can accurately online and on-site compensate the springback caused by the variations of the plate batch and the manufacturing error of the die. The present invention adopts the measurable and numerically controllable volume change of the liquid to realize the springback compensation, and has the advantages of high compensation precision, simple process, high efficiency, short cycle and low production cost, and can meet the accurate springback compensation of different batches of curved plate parts and high profile precision control requirements. Compared with the prior arts, the present invention can significantly improve the forming precision of the metal curved panel member by 30%-50% under the same technical conditions, the time cost on die machining is shortened by 70%, and the production cost is reduced by more than 40%.

The beneficial effects of the present invention are specifically manifested in the following aspects:

(1) High compensation accuracy: The present invention converts the springback compensation amount into the liquid volume change amount, and the liquid volume has the characteristics of measurable, numerically controllable, etc., and meets the needs of high-precision manufacturing of complex profiles of panel type component.

(2) Wide feasibility: The present invention can be applied to springback effect due to variation in material thickness and material properties, and to the problem of large dimensional dispersion, poor precision, and high rejection rate due to die manufacturing errors.

(3) The process is simple and the time cost on die modification is short: the present invention employs a hydroforming method, the sheet forming process and the springback compensation process which are completed together in one procedure, and the process is simple. In addition, the present invention overcomes the problem of long compensation period and repeated process try-out and mould adjustment in the traditional methods which require technical means such as pre-theoretic calculation, simulation prediction, post-machining for mould modification, and mould adjustment.

(4) Low production cost: the present invention can obtain a plate-type member that satisfies the forming precision requirements without mould modification, and can significantly reduce the production cost.

DETAILED DESCRIPTION OF THE PREFERRED EMBODIMENT

Embodiment 1

Figure 1:
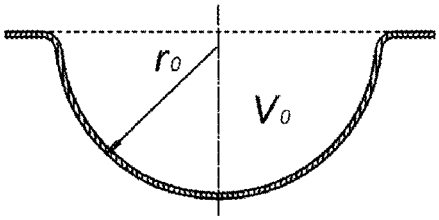
FIG. 1 illustrates a hemispherical curved member having a design radius $r_0$.
Figure 2:
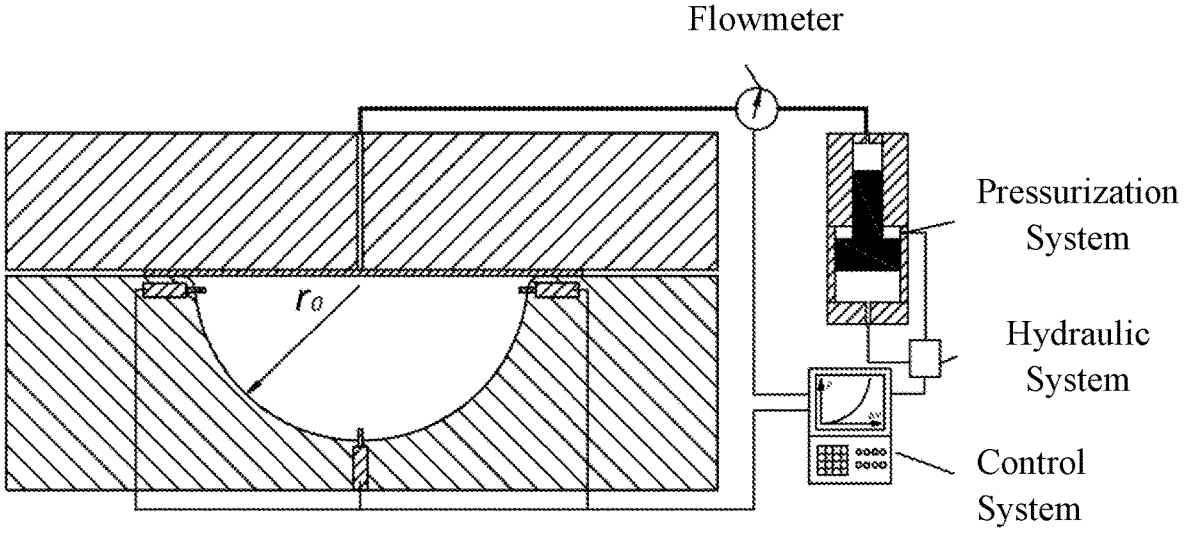
FIG. 2 illustrates an initial state of the forming process of the hemispherical curved member.
Figure 3:
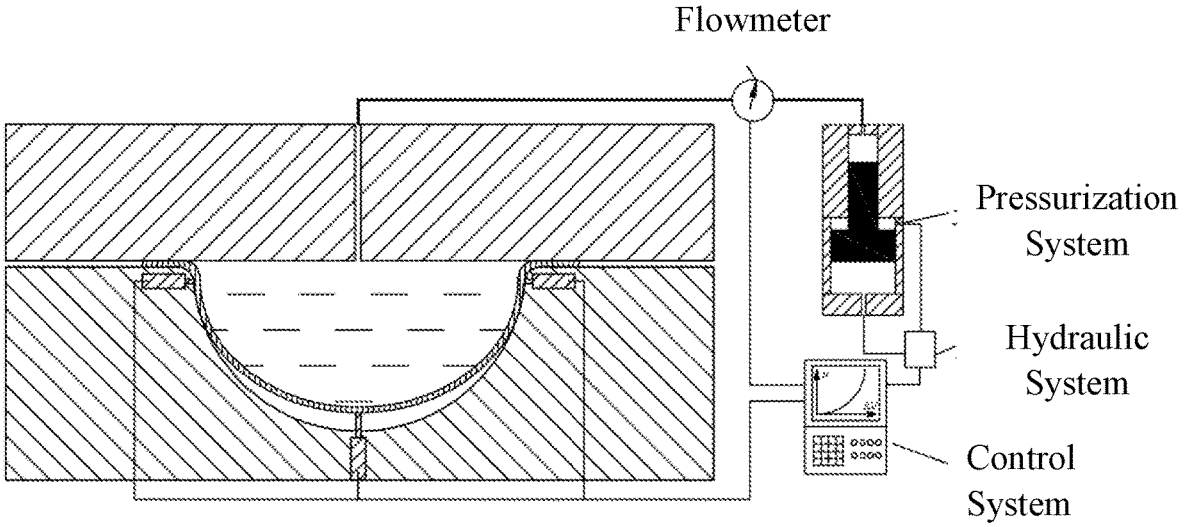
FIG. 3 illustrates an intermediate state of the forming process of the hemispherical curved member.
Figure 4:
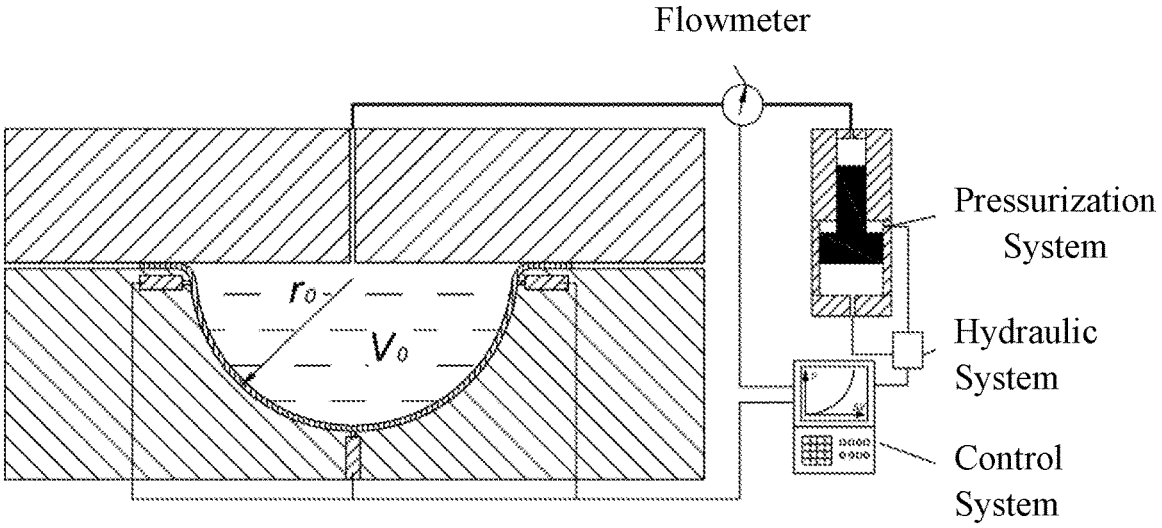
FIG. 4 illustrates a final state of the forming process of the hemispherical curved member (moulding state formed of the hemispherical curved member)
Figure 5:
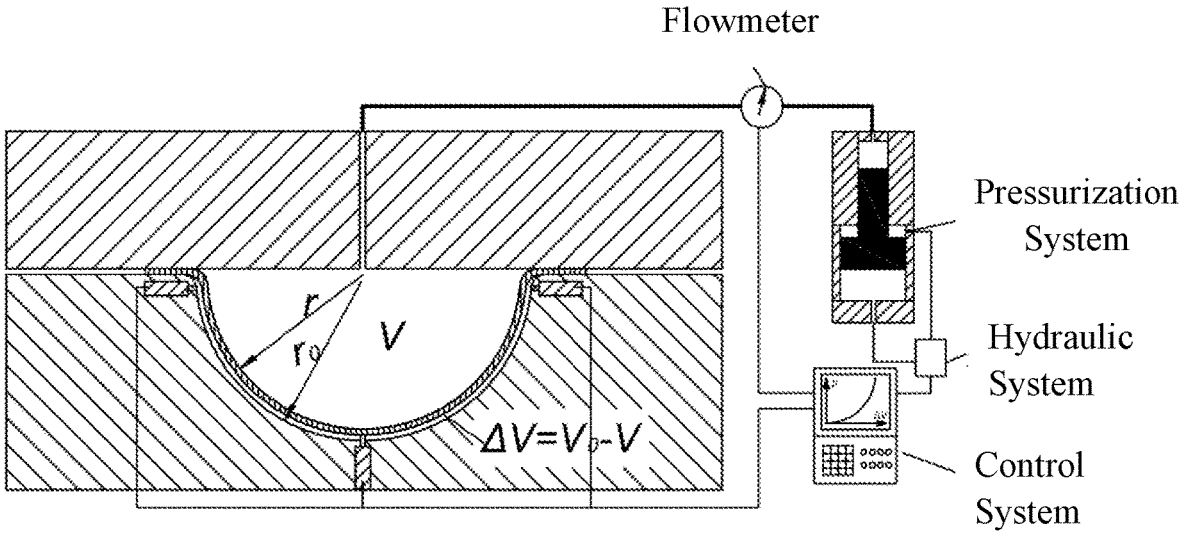
FIG. 5 illustrates a springback state occurred after unloading of the hemispherical curved member.
Figure 6:
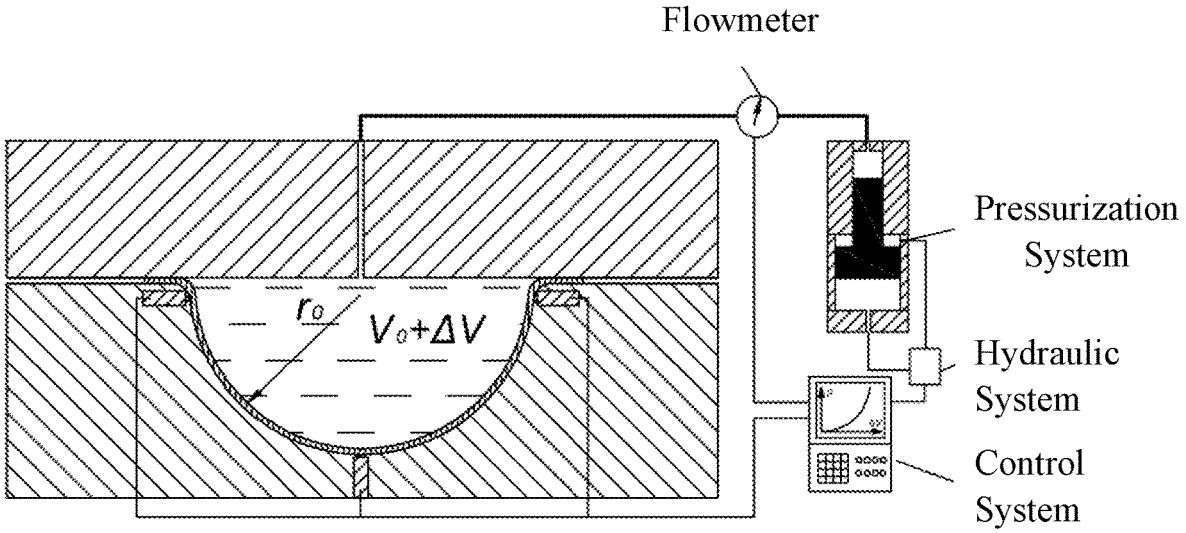
FIG. 6 illustrates a springback compensation state of the hemispherical curved member.
Figure 7:
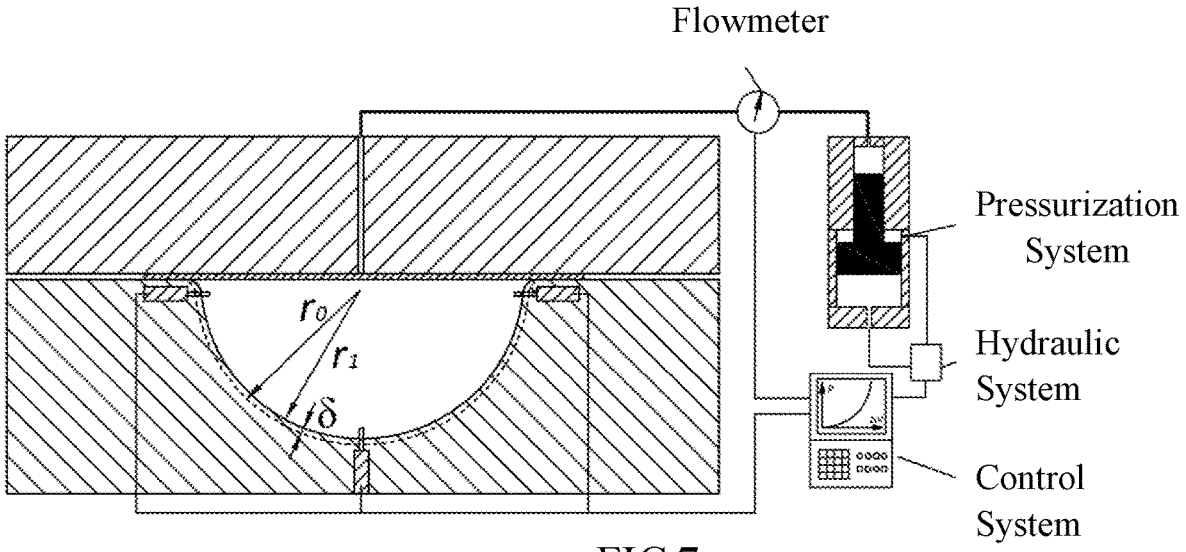
FIG. 7 illustrates an initial state of the curved member forming when the die has machining error.
Figure 8:
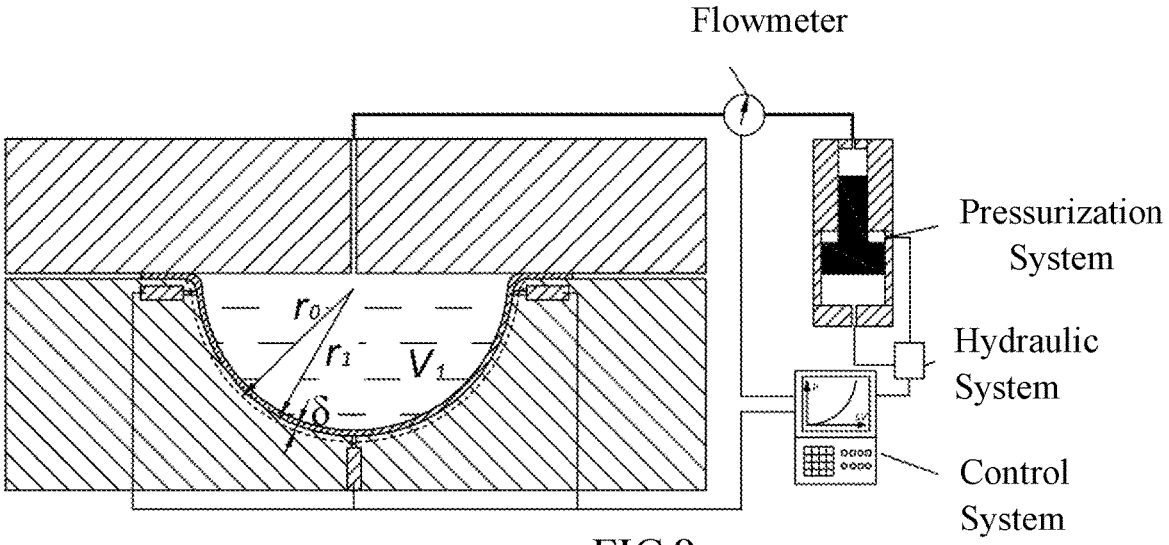
FIG. 8 illustrates a die forming state of the curved member forming when the die has machining error.
Figure 9:
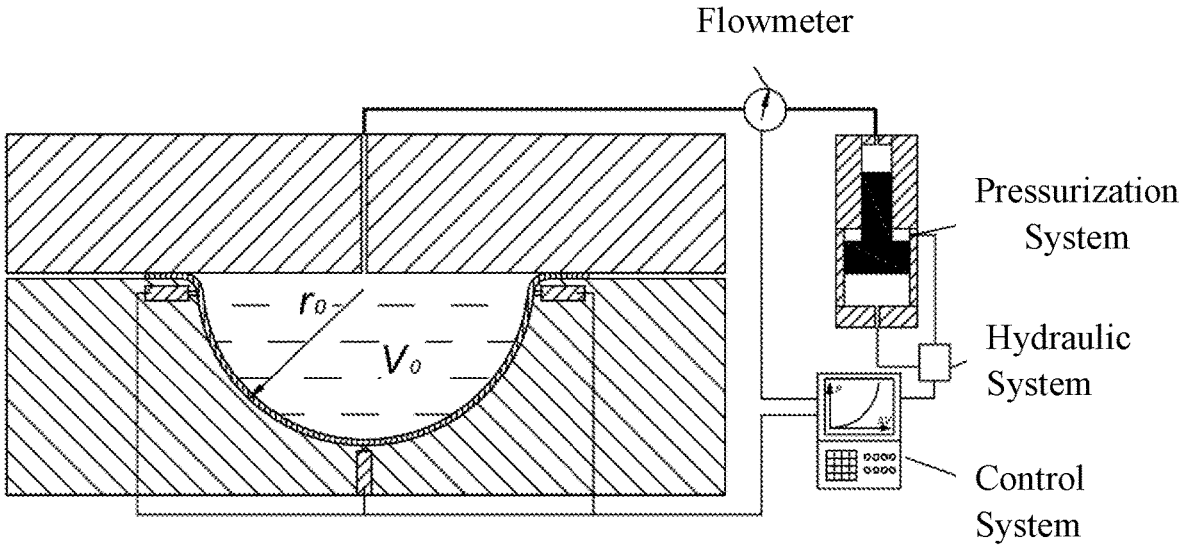
FIG. 9 illustrates a die profile compensation state when the die has manufacture error.
Figure 10:
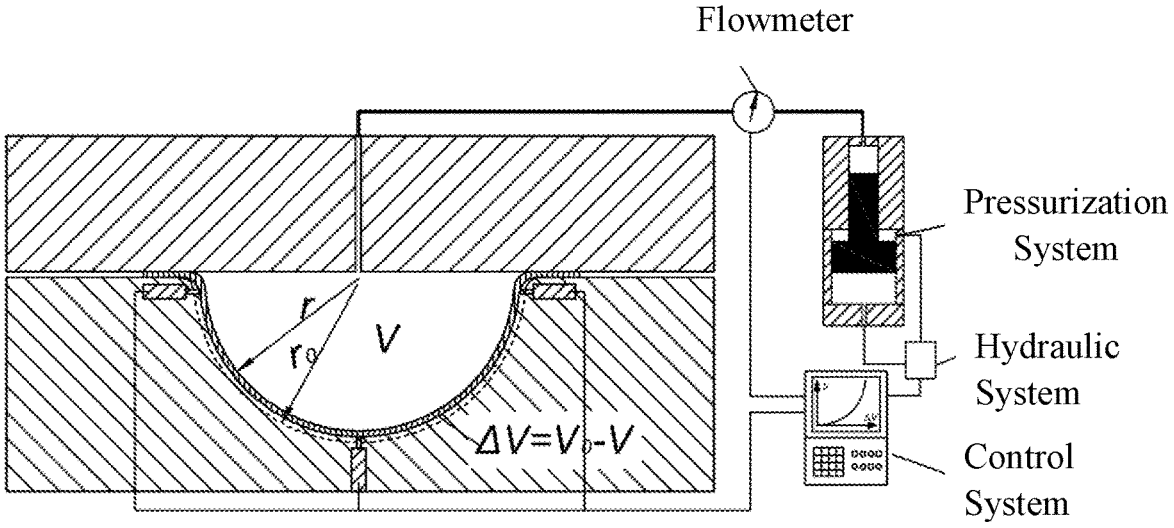
FIG. 10 illustrates a springback state of the curved member after unloading when the die has manufacture error.
Figure 11:
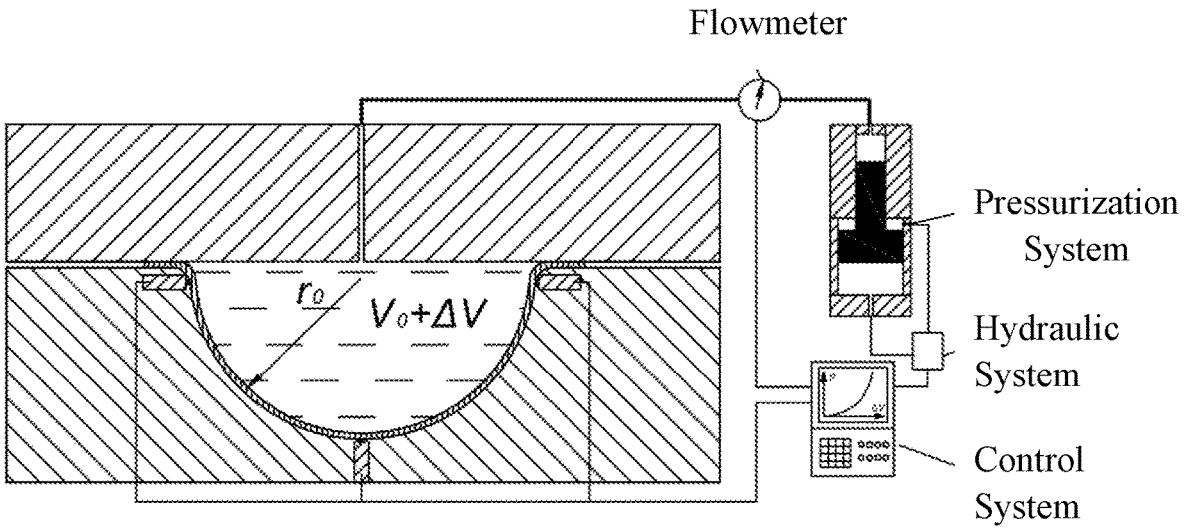
FIG. 11 illustrates a springback compensation process of the curved member when the die has manufacture error.

The present embodiment is implemented by the following steps:

Step 1: According to a designed profile of the curved panel member, calculating the corresponding theoretical volume $V_0$;

Step 2: Placing a plate blank on a die for moulding and filling the die with high pressure liquid through an external pressurization system so that the plate blank begins deep drawing with liquid as a punch under an action of liquid pressure for shape forming;

Step 3: Using a flowmeter to record a change of liquid flow inside the die, when a liquid volume being filled inside the die reaches $V_0$, stopping liquid filling through a control system and unloading;

Step 4: Using a displacement sensor to online and on-site measuring a distance between a profile of the unloaded part and a profile of its corresponding die, calculating an actual volume V of the unloaded part, then calculating to obtain a volume difference $\Delta V$ of $V_0$ and V;

Step 5: Filling the die with high pressure liquid again, when a liquid volume being filled inside the die reaches $V_0$, continuing to fill the die with high pressure liquid until elastic deformation of the die occurs, using a flowmeter to record a change of liquid flow inside the die, when a liquid volume being filled inside the die reaches $V_0+\Delta V$, stopping liquid filling through the control system, then unloading to obtain a curved panel member;

Step 6: For batch forming of subsequent parts, using a loaded volume of $V_0+\Delta V$.

Embodiment 2

In consideration of the ultra-high pressure in the entire process, in order to avoid the error caused by the volume compression of the liquid under the ultra-high pressure which may affect the precise control of the liquid volume, on the basis of the step 1 to step 5 of embodiment, this embodiment further comprises the following steps:

Step 6: based on the relationship between the liquid volume compression amount $\Delta V_p$ and the liquid pressure p, that is: $\Delta V_p=\beta\cdot p\cdot V$, calculating the liquid volume compression amount $V_p=\beta\cdot p\cdot(V0+\Delta V)$ when the liquid volume being filled inside the die is $(V_0+\Delta V)$, where $\beta$ is a compression coefficient of the liquid medium;

Step 7: Filling the die with liquid and pressurizing again until elastic deformation of the die occurs, recording a change of liquid flow inside the die by using a flowmeter, when a liquid volume being filled inside the die reaches $V_0+\Delta V+\Delta V_p$, stopping liquid filling through the control system then unloading to obtain a curved panel member.

Step 8: Proceeding batch forming of subsequent parts using a loaded volume of $V_0+\Delta V+\Delta Vp$.

Embodiment 3

In consideration of the machining error of die profile, when the actual size of the die cavity is smaller than the lower tolerance of the part size, the present invention can be used to realize a high-precision forming process of the curved panel member without modifying the die. This embodiment includes the following steps:

Step 1: According to a designed profile of the curved panel member and a measured profile of the die cavity, calculating the corresponding theoretical volume $V_0$ and the die cavity volume $V_1$, and calculating to obtain a volume difference $\Delta V_1$ of $V_0$ and $V_1$ according to $\Delta V_1=V_0-V_1$;

Step 2: Placing a plate blank on a die for moulding and filling the die with high pressure liquid through an external pressurization system so that the plate blank begins deep drawing with liquid as a punch under an action of liquid pressure for shape forming;

Step 3: Recording a change of liquid flow inside the die by using a flowmeter, when a liquid volume being filled inside the die reaches $V_1$, continuing to fill the die with high pressure liquid through an external pressurization system so that the die is elastically deformed, recording a change of liquid flow inside the die by using a flowmeter, when a liquid volume being filled inside the die reaches $V_1+\Delta V_1=V_0$, stopping liquid filling through the control system and unloading;

Step 4: using a displacement sensor to online and on-site measuring a distance between a part profile after unloading and a profile of the corresponding die, calculating an actual volume V of the unloaded part, and calculating a volume difference $\Delta V$ of $V_0$ and V according to $\Delta V=V_0-V$;

Step 5: Filling the die with high pressure liquid again so that the die is elastically deformed, recording a change of liquid flow inside the die by using a flowmeter, stopping liquid filling through the control system when a liquid volume being filled inside the die reaches $V_0+\Delta V$, then unloading to obtain a curved panel member.

Step 6: Proceeding batch forming of subsequent parts using a loaded volume of $V_0+\Delta V$.

EXEMPLARY EMBODIMENTS

Exemplary Embodiment 1

Taking 2219 aluminum alloy hemispherical head parts as an example, where: $r_0$ is the design radius of the head part, and r is the radius of the head part after unloading and being springback. The implementation process of the present invention is described with reference to FIG. 1 to FIG. 6:

Step 1: based on the design radius of the hemispherical head part $r_0$, calculating the corresponding theoretical volume $V_0=2\pi r_0^3/3$;

Step 2: Placing a round plate blank to a die with a cavity radius $r_0$ for moulding, filling the die with water and increasing pressure through an external pressurization system so that the plate blank begins deep drawing with liquid as a punch under an action of water pressure;

Step 3: Using a flowmeter to record a change of water flow inside the die, when a liquid volume being filled inside the die reaches $V_0$, stopping water filling through a control system and unloading;

Step 4: Using a displacement sensor to measure a distance between the part and a profile of the die, calculating a measured radius of the part after unloading r, calculating an actual volume V of the part according to $V=2\pi r^3/3$, and calculating to obtain a volume difference $\Delta V$ of $V_0$ and V according to $\Delta V=V_0-V=2\pi(r_0^3-r^3)/3$;

Step 5: Filling the die with water and pressurizing again, when a water volume being filled inside the die reaches $V_0$, continuing to fill the die with water and pressurizing so that the die is elastically deformed, using a flowmeter to record a change of water flow inside the die, when a liquid volume being filled inside the die reaches $V_0+\Delta V=2\pi(2r_0^3-r^3)/3$, stopping water filling through the control system, and then unloading to obtain a head part.

Step 6: For subsequent batch forming of head parts, loading liquid according to $2\pi(2r_0^3-r^3)/3$.

Exemplary Embodiment 2

Taking 2219 aluminum alloy hemispherical head parts as an example, where: $r_0$ is the design radius of the head part, and r is the radius of the head part after unloading and after springback. In order to avoid the error caused by the volume compression of the liquid under the ultra-high pressure, this exemplary embodiment includes the step 1 to step 5 which are the same as that of exemplary embodiment 1 and further includes the following steps:

Step 6: recording the liquid pressure p when the liquid volume being filled inside the die is $(V_0+\Delta V)$, according to the formula of the liquid volume compression amount $\Delta V_p=\beta\cdot p\cdot(V0+\Delta V)$, calculating the liquid volume compression amount of the liquid filled in the die according to $\Delta V_p=\beta\cdot p\cdot 2\pi(2r_0^3-r^3)/3$, where where $\beta$ is a compression coefficient of the liquid medium;

Step 7: Filling the die with liquid and pressurizing again until elastic deformation of the die occurs, recording a change of water flow inside the die by using a flowmeter, when a liquid volume being filled inside the die reaches $V_0+\Delta V+\Delta V_p=(\beta\cdot p+1)\times[2\pi(2r_0^3-r^3)/3]$, stopping liquid filling, and unloading to obtain a head part.

Step 8: For subsequent batch forming of head parts, loading liquid according to $(\beta\cdot p+1)\times[2\pi(2r_0^3-r^3)/3]$.

Exemplary Embodiment 3

Taking 2219 aluminum alloy hemispherical head parts as an example, wherein: $r_0$ is the design radius of the head part, because of the machining error, the actual measured radius of the die cavity is $r_1=r_0-\delta$ ($\delta$ is the design tolerance), and r is the radius of the head part after unloading and after springback. The present invention can be used to realize a first-time high-precision forming process of the curved panel member without modifying the die. The implementation process of the present invention is described with reference to FIG. 7 to FIG. 11:

Step 1: based on the design radius of the hemispherical head part $r_0$ and the actual measured radius of the die cavity $r_1$, calculating the corresponding theoretical volume $V_0=2\pi r_0^3/3$ and the die cavity volume $V_1=2\pi r_1^3/3$, then calculating to obtain a volume difference $\Delta V_1$ of $V_0$ and $V_1$ according to $\Delta V_1=V_0-V_1=2\pi(r_0^3-r_1^3)/3$;

Step 2: Placing a round plate blank to a die with a cavity radius $r_1$ for moulding, filling the die with water and increasing pressure through an external pressurization system so that the plate blank begins deep drawing with liquid as a punch under an action of water pressure;

Step 3: Using a flowmeter to record a change of water flow inside the die, when a liquid volume being filled inside the die reaches $V_1$, continuing to fill the die with water and pressurizing so that the die is elastically deformed, using a flowmeter to record a change of water flow inside the die, when a liquid volume being filled inside the die reaches $V_1-\Delta V_1=V_0=2\pi r_0^3/3$, stopping water filling through the control system, and then unloading;

Step 4: Using a displacement sensor to measure a distance between the part and a profile of the die, calculating a measured radius of the part after unloading r, calculating an actual measured volume V of the part according to $V=2\pi r^3/3$, and calculating to obtain a volume difference $\Delta V$ of $V_0$ and V according to $\Delta V=V_0-V=2\pi(r_0^3-r^3)/3$;

Step 5: Filling the die with water and pressurizing again so that the die is elastically deformed, using a flowmeter to record a change of water flow inside the die, when a liquid volume being filled inside the die reaches $V_0+\Delta V=2\pi(2r_0^3-r^3)/3$, stopping water filling through the control system, and then unloading to obtain a head part.

Step 6: For subsequent batch forming of head parts, loading liquid according to $2\pi(2r_0^3-r^3)/3$.

Embodiment 4

Figure 12:
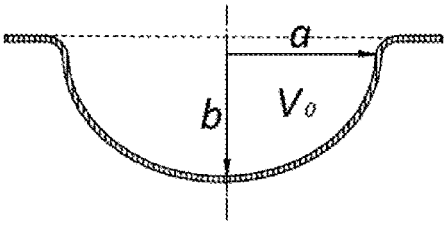
FIG. 12 illustrates a semi-ellipsoidal curved member with radii of long axis and short axis of a and b respectively.
Figure 13:
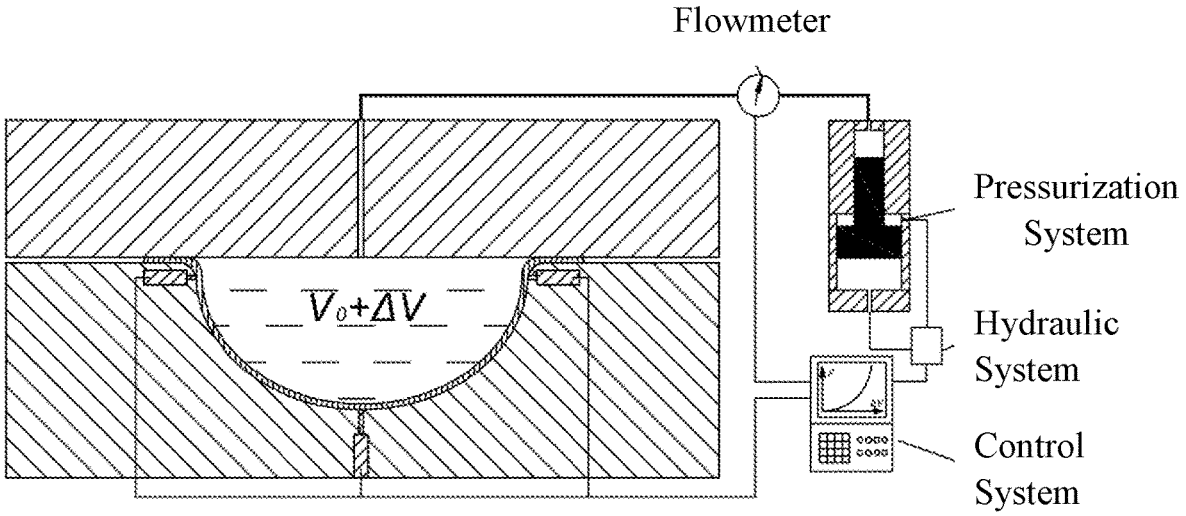
FIG. 13 illustrates a springback compensation process of the semi-ellipsoidal curved member.

Taking 2219 aluminum alloy semi-ellipsoidal head parts as an example, where: co is the long axis radius of the head part, $b_0$ is the short axis radius of the head part. The implementation process of the present invention is described with reference to FIG. 12 to FIG. 13:

Step 1: based on the long and short radii of the semi-ellipsoidal head part, calculating the corresponding theoretical volume $V_0=2\pi a_0^2 b_0/3$;

Step 2: Placing a round plate blank to a die with a cavity long and short radii of $a_0$ and $b_0$ for moulding, filling the die with water and increasing pressure through an external pressurization system so that the plate blank begins deep drawing with liquid as a punch under an action of water pressure;

Step 3: Using a flowmeter to record a change of water flow inside the die, when a liquid volume being filled inside the die reaches $V_0$, stopping water filling through a control system and unloading;

Step 4: Using a displacement sensor to measure a distance between the part and a profile of the die, calculating a measured long and short radii of the part after unloading, calculating an actual measured volume V of the part according to $V=2a^2b/3$, and calculating to obtain a volume difference $\Delta V$ of $V_0$ and V according to $\Delta V=V_0-V=2\pi(a_0^2b_0-a^2b)/3$;

Step 5: Filling the die with water and pressurizing again, when a water volume being filled inside the die reaches $V_0$, continuing to fill the die with water and pressurizing so that the die is elastically deformed, using a flowmeter to record a change of water flow inside the die, when a liquid volume being filled inside the die reaches $V_0+\Delta V=2\pi(2a_0^2b_0-a^2b)/3$, stopping water filling through the control system, and then unloading to obtain a semi-ellipsoidal head part.

Step 6: For subsequent batch forming of head parts, loading liquid according to $2\pi(2a_0^2b_0-a^2b)/3$.

Embodiment 5

Figure 14:
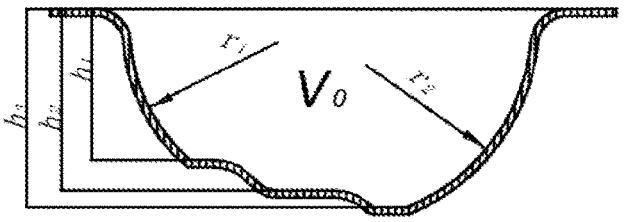
FIG. 14 illustrates a complex curved member with irregular shape.
Figure 15:
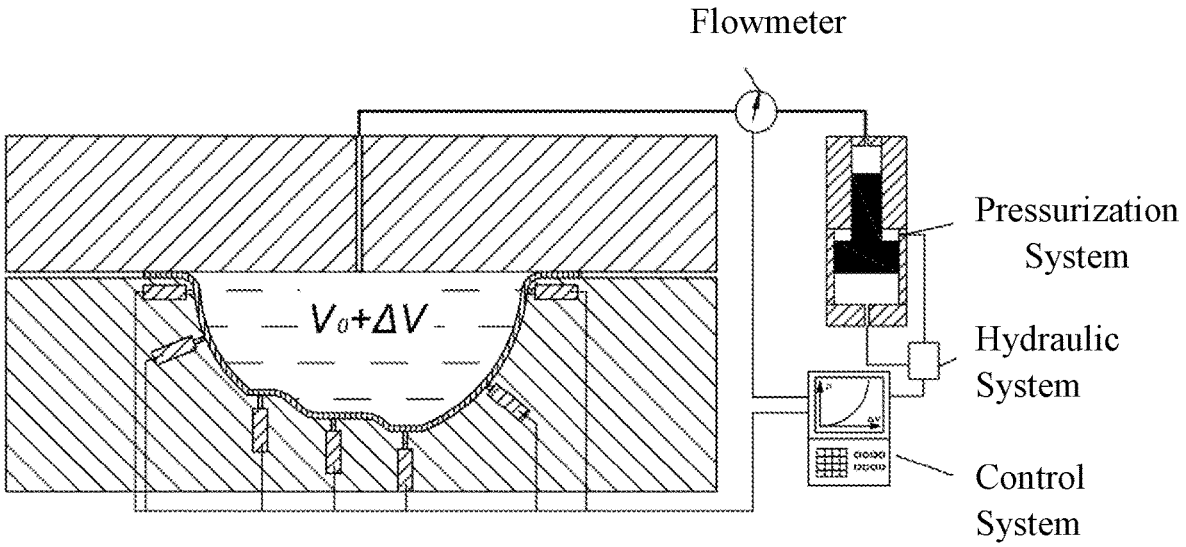
FIG. 15 illustrates a springback compensation process of the complex curved member with irregular shape.
Figure 16:
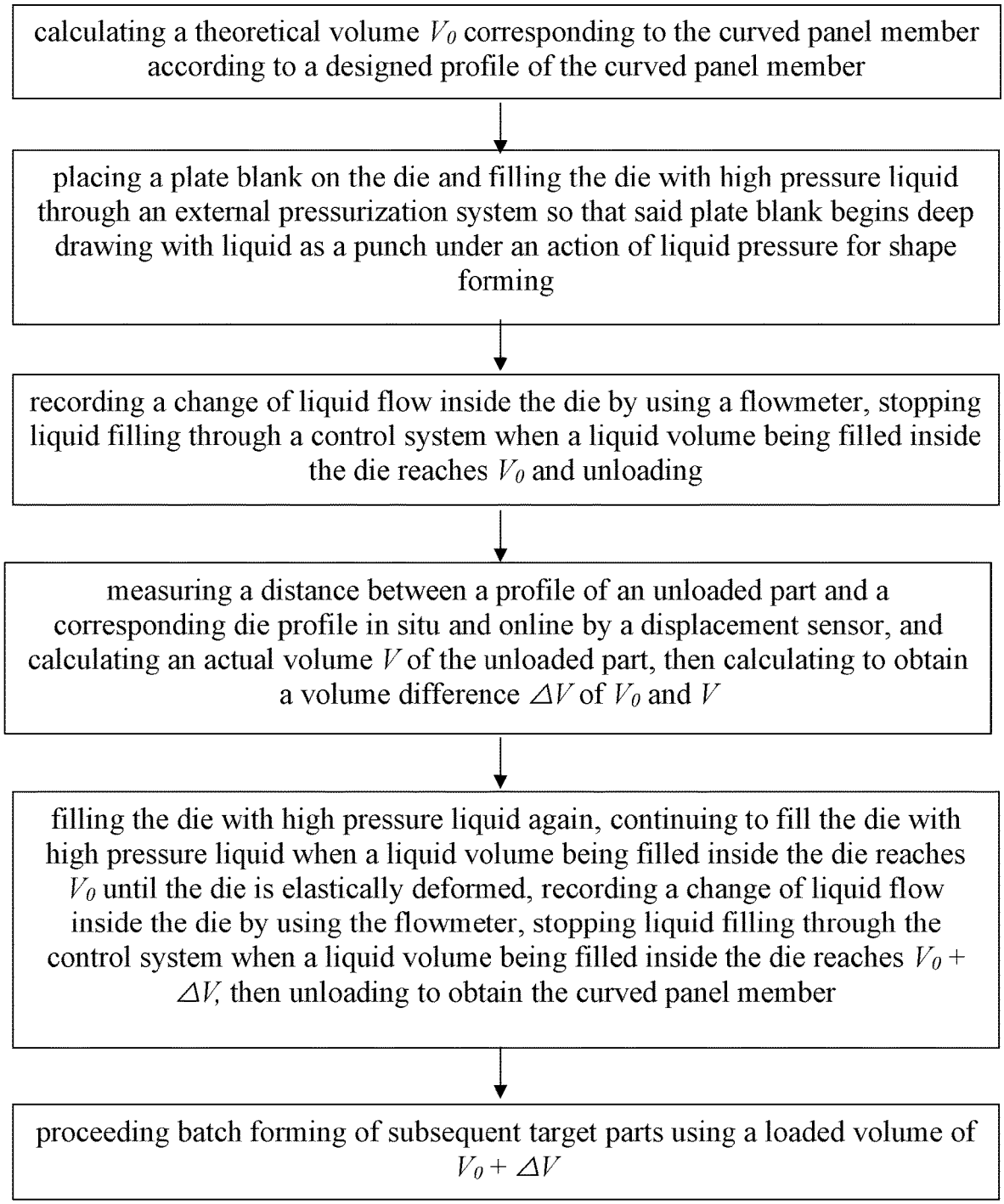
FIG. 16 illustrates a flow chart of an accurate springback compensation method for hydroforming component based on liquid volume control according to Embodiment 1 of the present invention.

Taking 5A06 aluminum alloy irregular-shape complex curved surface parts as an example, where: $h_1$, $h_2$, $h_3$ are the corresponding step plane height of the complex curved-surface part, $r_1$ and $r_2$ are radius of two curved surface respectively. The implementation process of the present invention is described with reference to FIG. 14 to FIG. 15:

Step 1: based on the designed profile of the complex curved-surface part, calculating the corresponding theoretical volume $V_0$;

Step 2: Placing a plate blank on a die for moulding, filling the die with water and increasing pressure through an external pressurization system so that the plate blank begins deep drawing with liquid as a punch under an action of water pressure;

Step 3: Using a flowmeter to record a change of water flow inside the die, when a liquid volume being filled inside the die reaches $V_0$, stopping water filling through a control system and unloading;

Step 4: Using a displacement sensor to measure a distance between the part and a profile of the die, calculating an actual measured volume V of the part, and calculating to obtain a volume difference $\Delta V$ of $V_0$ and V;

Step 5: Filling the die with water and pressurizing again, when a water volume being filled inside the die reaches $V_0$, continuing to fill the die with water and pressurizing so that the die is elastically deformed, using a flowmeter to record a change of water flow inside the die, when a liquid volume being filled inside the die reaches $V_0+\Delta V$, stopping water filling through the control system, and then unloading to obtain a complex curved-surface part.

Step 6: For subsequent batch forming of head parts, loading liquid according to $V_0+\Delta V$.

Under the same testing conditions, compared with the existing method of controlling the liquid pressure to control the springback, the method of the present invention improves the part profile accuracy by at least 20%, the yield rate by at least 10%, and the work efficiency by at least 70%.

What is claimed is:

1. An accurate springback compensation method for hydroforming component based on liquid volume control, comprising the steps of, (a) inducing an elastic deformation of a die by regulating a volume of injected liquid based on a volume difference between a theoretical volume of a target part and a volume of the part after springback, and (b) controlling a die deformation amount equal to a springback amount and realizing an accurate springback compensation control of a curved panel member, wherein said method further comprises the steps of:

step 1: calculating a theoretical volume $V_0$ corresponding to the curved panel member according to a designed profile of the curved panel member;

step 2: placing a plate blank on the die and filling the die with high pressure liquid through an external pressurization system so that said plate blank begins deep drawing with liquid as a punch under an action of liquid pressure for shape forming;

step 3: recording a change of liquid flow inside the die by using a flowmeter, stopping liquid filling through a control system when a liquid volume being filled inside the die reaches $V_0$ and unloading;

step 4: measuring a distance between a profile of an unloaded part and a corresponding die profile in situ and online by a displacement sensor, and calculating an actual volume V of the unloaded part, then calculating to obtain a volume difference $\Delta V$ of $V_0$ and V;

step 5: filling the die with high pressure liquid again, continuing to fill the die with high pressure liquid when a liquid volume being filled inside the die reaches $V_0$ until the die is elastically deformed, recording a change of liquid flow inside the die by using the flowmeter, stopping liquid filling through the control system when a liquid volume being filled inside the die reaches $V_0+\Delta V$, then unloading to obtain the curved panel member;

step 6: proceeding batch forming of subsequent target parts using a loaded volume of $V_0+\Delta V$.

2. The accurate springback compensation method for hydroforming component based on liquid volume control according to claim 1, characterized in that, in the step (2), the plate blank is a sheet metal.

3. The accurate springback compensation method for hydroforming component based on liquid volume control according to claim 2, characterized in that, the sheet metal includes but not limited to aluminum alloy, low carbon steel, and high strength steel.

4. An accurate springback compensation method for hydroforming component based on liquid volume control, comprising the steps of: (a) inducing an elastic deformation of a die by regulating a volume of injected liquid based on a volume difference between a theoretical volume of a target part and a volume of the part after springback, and (b) controlling a die deformation amount equal to a springback amount and realizing an accurate springback compensation control of a curved panel member, wherein said method further comprises the steps of:

step 1: calculating a theoretical volume $V_0$ corresponding to the curved panel member according to a designed profile of the curved panel member;

step 2: placing a plate blank on the die and filling the die with high pressure liquid through an external pressurization system so that said plate blank begins deep drawing with liquid as a punch under an action of liquid pressure for shape forming;

step 3: recording a change of liquid flow inside the die by using a flowmeter, stopping liquid filling through a control system when a liquid volume being filled inside the die reaches $V_0$ and unloading;

step 4: measuring a distance between a profile of an unloaded part and a corresponding die profile in situ and online by a displacement sensor, and calculating an actual volume V of the unloaded part, then calculating to obtain a volume difference $\Delta V$ of $V_0$ and V;

step 5: filling the die with high pressure liquid again, continuing to fill the die with high pressure liquid when a liquid volume being filled inside the die reaches $V_0$ until the die is elastically deformed, recording a change of liquid flow inside the die by using the flowmeter, stopping liquid filling through the control system when a liquid volume being filled inside the die reaches $V_0+\Delta V$, then unloading to obtain the curved panel member;

step 6: calculating the liquid volume compression amount $\Delta Vp=\beta\cdot p\cdot(V0+\Delta V)$ when the liquid volume being filled inside the die is $(V_0+\Delta V)$ based on the relationship between the liquid volume compression amount $\Delta Vp$ and the liquid pressure p: $\Delta Vp=\beta\cdot p\cdot V$, where $\beta$ is a compression coefficient of the liquid medium;

step 7: filling the die with liquid and pressurizing again for elastic deformation of the die, recording a change of liquid flow inside the die by using the flowmeter, stopping liquid filling through the control system when a liquid volume being filled inside the die reaches $V_0+\Delta V+\Delta Vp$, then unloading to obtain the curved panel member;

step 8: proceeding batch forming of subsequent target parts using a loaded volume of $V_0+\Delta V+\Delta Vp$.

5. The accurate springback compensation method for hydroforming component based on liquid volume control according to claim 4, characterized in that, in the step (2), the plate blank is a sheet metal.

6. The accurate springback compensation method for hydroforming component based on liquid volume control according to claim 5, characterized in that, the sheet metal includes but not limited to aluminum alloy, low carbon steel, and high strength steel.

7. An accurate springback compensation method for hydroforming component based on liquid volume control, comprising the steps of: (a) inducing an elastic deformation of a die by regulating a volume of injected liquid based on a volume difference between a theoretical volume of a target part and a volume of the part after springback, and controlling a die deformation amount equal to a springback amount and realizing an accurate springback compensation control of a curved panel member, wherein said method further comprises the steps of:

step 1: calculating a theoretical volume $V_0$ and a die cavity volume $V_1$ according to a designed profile of the curved panel member and a measured profile of the die cavity correspondingly, then calculating to obtain a volume difference $\Delta V_1$ of $V_0$ and $V_1$ equal to $V_0-V_1$ (i.e. $\Delta V_1=V_0-V_1$);

step 2: placing a plate blank on the dice and filling the die with high pressure liquid through an external pressurization system so that said plate blank begins deep drawing with liquid as a punch under an action of liquid pressure for shape forming;

step 3: recording a change of liquid flow inside the die by using a flowmeter, continuing to fill the die with high pressure liquid through an external pressurization system when a liquid volume being filled inside the die reaches $V_1$ so that the die is elastically deformed, recording a change of liquid flow inside the die by using the flowmeter, stopping liquid filling through the control system when a liquid volume being filled inside the die reaches $V_1+\Delta V_1=V_0$ and unloading;

step 4: measuring a distance between a profile of the unloaded part and a corresponding die profile in situ and online by a displacement sensor, and calculating an actual volume V of the unloaded part, then calculating a volume difference $\Delta V$ of $V_0$ and V equal to $V_0-V$ (i.e. $\Delta V=V_0-V$);

step 5: filling the die with high pressure liquid again so that the die is elastically deformed, recording a change of liquid flow inside the die by using the flowmeter, stopping liquid filling through the control system when a liquid volume being filled inside the die reaches $V_0+\Delta V$, then unloading to obtain the curved panel member;

step 6: proceeding batch forming of subsequent target parts using a loaded volume of $V_0+\Delta V$.

8. The accurate springback compensation method for hydroforming component based on liquid volume control according to claim 7, characterized in that, in the step (2), the plate blank is a sheet metal.

9. The accurate springback compensation method for hydroforming component based on liquid volume control according to claim 8, characterized in that, the sheet metal includes but not limited to aluminum alloy, low carbon steel, and high strength steel.

* * * * *